US008429834B2

(12) United States Patent
Fujioka et al.

(10) Patent No.: US 8,429,834 B2
(45) Date of Patent: Apr. 30, 2013

(54) GAS WIPING APPARATUS

(75) Inventors: Hironori Fujioka, Hiroshima (JP); Takashi Yonekura, Hiroshima (JP); Masashi Yoshikawa, Hiroshima (JP)

(73) Assignee: Mitsubishi-Hitachi Metals Machinery, Inc., Tokyo (JP)

( * ) Notice: Subject to any disclaimer, the term of this patent is extended or adjusted under 35 U.S.C. 154(b) by 542 days.

(21) Appl. No.: 12/716,440

(22) Filed: Mar. 3, 2010

(65) Prior Publication Data

US 2010/0224120 A1 Sep. 9, 2010

(30) Foreign Application Priority Data

Mar. 6, 2009 (JP) ..... 2009-053164
Jun. 15, 2009 (JP) ..... 2009-141769

(51) Int. Cl.
*F26B 13/00* (2006.01)

(52) U.S. Cl.
USPC ..... 34/623; 34/629; 34/631; 34/639; 34/655; 118/63

(58) Field of Classification Search ..... 34/623, 34/629, 631, 639, 655; 118/63
See application file for complete search history.

(56) References Cited

U.S. PATENT DOCUMENTS 6,199,301 B1 * 3/2001 Wallace ..... 34/623

FOREIGN PATENT DOCUMENTS

| | | | |
|---|---|---|---|
| JP | 6-330275 | A | 11/1994 |
| JP | 3533775 | B2 | 3/2004 |
| JP | 2006-274381 | A | 10/2006 |
| JP | 4020217 | B2 | 10/2007 |

* cited by examiner

*Primary Examiner* — Marianne L Padgett
*Assistant Examiner* — Stephen Kitt
(74) *Attorney, Agent, or Firm* — Birch, Stewart, Kolasch & Birch, LLP

(57) ABSTRACT

In a gas wiping apparatus which blows gas through a wiping nozzle onto front and rear surfaces of a steel plate going out from a molten metal coating pot and running upward and which thereby controls a deposit mass, the wiping nozzle is separated into upper and lower lips, blocking faces partially closing a gas supply channel are formed in the upper and lower lips at vertically different positions on the opposite sides from each other in a gas outlet width direction, and the upper and lower lips are provided in such a manner as to be movable in a width direction of the steel plate.

3 Claims, 12 Drawing Sheets

(Along A−A)

(Along B−B)

(Along C−C)

(Along D–D)

(Along E–E)

GAS WIPING APPARATUS

TECHNICAL FIELD

The present invention relates to a gas wiping apparatus used for hot dip galvanizing equipment in a hot dip galvanizing line for coating zinc or the like.

BACKGROUND ART

In this type of hot dip galvanizing line, generally, a strip (a steel plate being plated) continuously subjected to pretreatments including annealing and held at high temperature is passed between sink rolls in a molten metal coating pot and is conveyed upward. During the upward conveyance, a deposit mass (thickness of coated molten metal, or film thickness) is controlled. The strip is then cooled to normal temperature according to a predetermined cooling pattern.

While the strip is being conveyed upward, excess molten zinc adhering to the surface of the strip is wiped by gas blown from a pair of wiping nozzles (gas wiping apparatuses) situated above the molten metal coating pot in such a manner as to face each other, for example, thus controlling the deposit mass to a desired amount <see Patent Literature 1>.

For example, as shown in FIGS. 11, 12A, and 12B, a conventional gas wiping apparatus is designed so that gas supplied from the inside of a nozzle header 100 through a gas supply channel 101 to a wiping nozzle 102 is evenly blown out from a nozzle slit 105 defined between facing surfaces of upper and lower lips 103 and 104 of the wiping nozzle 102 in a width direction of a not-shown strip.

[Citation List]

[Patent Literature 1]

Japanese Patent Application Publication No. Hei 6-330275

[Patent Literature 2]

Japanese Patent No. 4020217

[Patent Literature 3]

Japanese Patent No. 3533775

[Patent Literature 4]

Japanese Patent Application Publication No. 2006-274381

SUMMARY OF INVENTION

Technical Problem

The conventional gas wiping apparatus as described above has a structure in which the upper and lower lips 103 and 104 are integrated with each other by multiple vertically fixing bolts 106 (see FIG. 12A) and are integrated with the nozzle header 100 by multiple horizontally fixing bolts 107 (see FIG. 12B)

Accordingly, the gas outlet width of the nozzle slit 105 in the width direction of the strip is fixed and is set not less than the maximum width of the strip. When a narrow strip is subjected to wiping, gas flowing outside the strip in the width direction is wasted. Moreover, the opposing gas flows collide with each other at high speed and will cause noise, plate vibrations and edge over-coating.

An object of the present invention is to provide a gas wiping apparatus in which the gas outlet width and position of a nozzle slit in a strip width direction are made variable with a simple structure of lips of a wiping nozzle made movable in the strip width direction and which is thus capable of preventing waste of gas while reducing noise, plate vibrations, and occurrence of edge over-coating.

Patent Literatures 2 and 3 disclose gas wiping apparatuses in which a pair of lips defining a nozzle slit of a wiping nozzle is made movable relatively in the strip width direction. According to these apparatuses, the gap of the nozzle slit (a distance between the lips) is adjusted through the relative movement of the pair of lips, but the gas outlet width and position of the nozzle slit in the strip width direction cannot be changed.

Patent Literature 4 discloses a gas wiping apparatus in which a gas outlet width and position of a nozzle slit in a strip width direction are made variable by providing shutoff belts to shut off the flow of gas within a wiping nozzle and side plates which are inserted in the nozzle slit and are integrally move with the shutoff belts and advancing and retracting the shutoff belts between each end of a gas flow chamber and the center thereof. According to this apparatus, the number of parts is increased including the shutoff belts and side plates, and the structure including the movement mechanism is complicated, thus increasing the cost and degrading the reliability of the apparatus.

Solution to Problem

A first aspect of the present invention to achieve the object provides a gas wiping apparatus which blows gas through a wiping nozzle onto front and rear surfaces of a steel plate going out from a molten metal coating pot and running upward and which thereby controls a deposit mass. The wiping nozzle is separated into an upper lip and a lower lip, blocking faces partially closing a gas supply channel are formed in the upper and lower lips at vertically different positions on opposite sides from each other in a gas outlet width direction, and the upper and lower lips are provided in such a manner as to be movable in a width direction of the steel plate.

According to a second aspect of the present invention, the upper and lower lips are supported on a gas supply base including the gas supply channel in such a manner as to be slidable in the width direction of the steel plate, and are fixable at arbitrary positions by lip holders.

According to a third aspect of the present invention, recess portions are respectively formed, at such positions as to be always located near ends of the steel plate, in facing surfaces which form a nozzle slit of the upper and lower lips, so that a gap of the nozzle slit is made larger near the ends of the steel plate than near a center of the steel plate.

According to a fourth aspect of the present invention, the gas wiping apparatus includes: a movement mechanism allowing the upper and lower lips to independently move in the width direction of the steel plate; drive means for independently moving the upper and lower lips; plate end detection sensors respectively attached to the upper and lower lips so as to detect end portions of the steel plate; and control means for controlling the drive means on a basis of detection signals from the plate end detection sensors so as to adapt the upper and lower lips to changes in position of the end portions of the steel plate.

According to a fifth aspect of the present invention, the upper and lower lips are provided with baffle plates.

According to a sixth aspect of the present invention, the upper and lower lips are supported to be independently movable in the width direction of the steel plate and are replaceable.

Advantageous Effects of Invention

According to the gas wiping apparatus of the present invention having the aforementioned configuration, it is possible to change the gas outlet width of the nozzle slit in the steel plate width direction according to the width of the steel plate with such a simple structure that the wiping nozzle is separated into the upper and lower lips and the upper and lower lips are moved oppositely in the steel plate width directions. Moreover, by moving the upper and lower lips toward the same end of the steel plate in the width direction thereof, the gas outlet position of the nozzle slit in the width direction of the steel plate can be changed according to the meandering steel plate.

Consequently, it is possible to prevent waste of gas flowing outside the plate in the width direction and prevent noise, plate vibrations, and occurrence of edge over-coating due to high speed collision of the opposing gas flows.

DESCRIPTION OF EMBODIMENTS

Hereinafter, a gas wiping apparatus according to the present invention is described with embodiments in detail with reference to the drawings.

[Embodiment 1]

Figure 1:
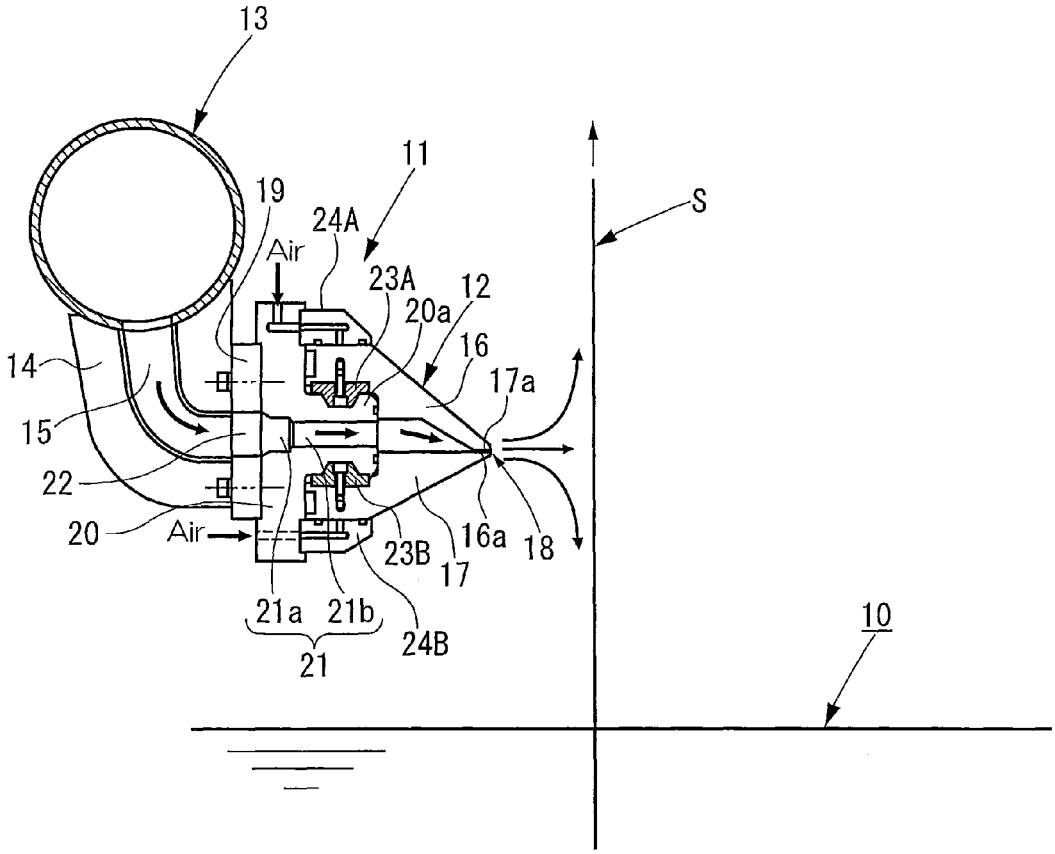
FIG. 1 shows a schematic side view of a structure of a gas wiping apparatus used for hot dip galvanizing equipment in a hot dip galvanizing line for zinc and the like, illustrating Embodiment 1 of the present invention.
Figure 2A:
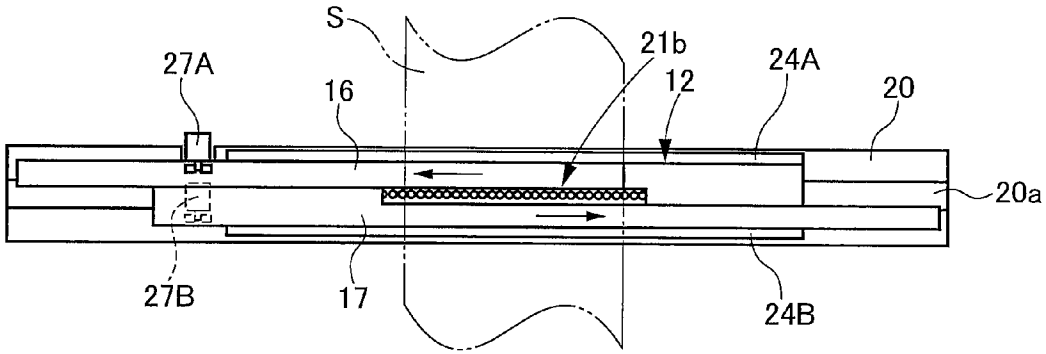
FIG. 2A shows a view corresponding to a cross-sectional view indicated by arrows F of FIG. 3, illustrating another operational state of a wiping nozzle in the case of a narrow strip.
Figure 2B:
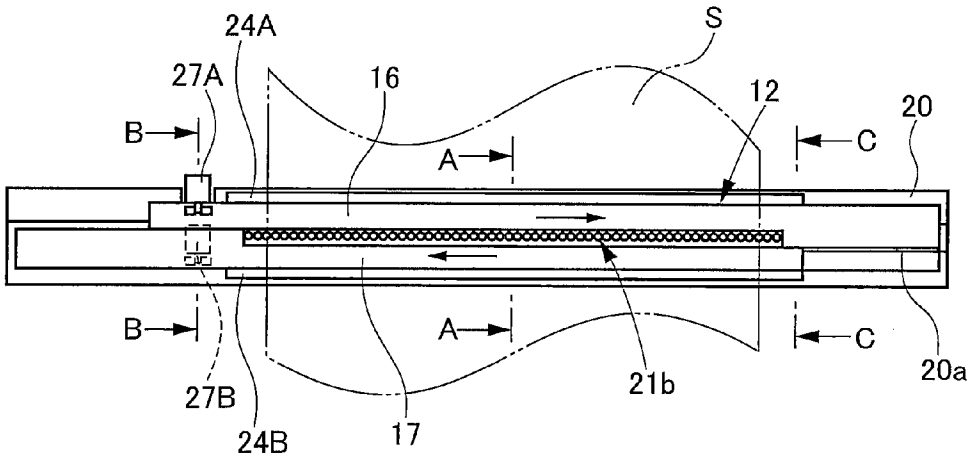
FIG. 2B shows a view corresponding to a cross-sectional view indicated by arrows F of FIG. 3, illustrating still another operational state of the wiping nozzle in the case of a wide strip.
Figure 3:
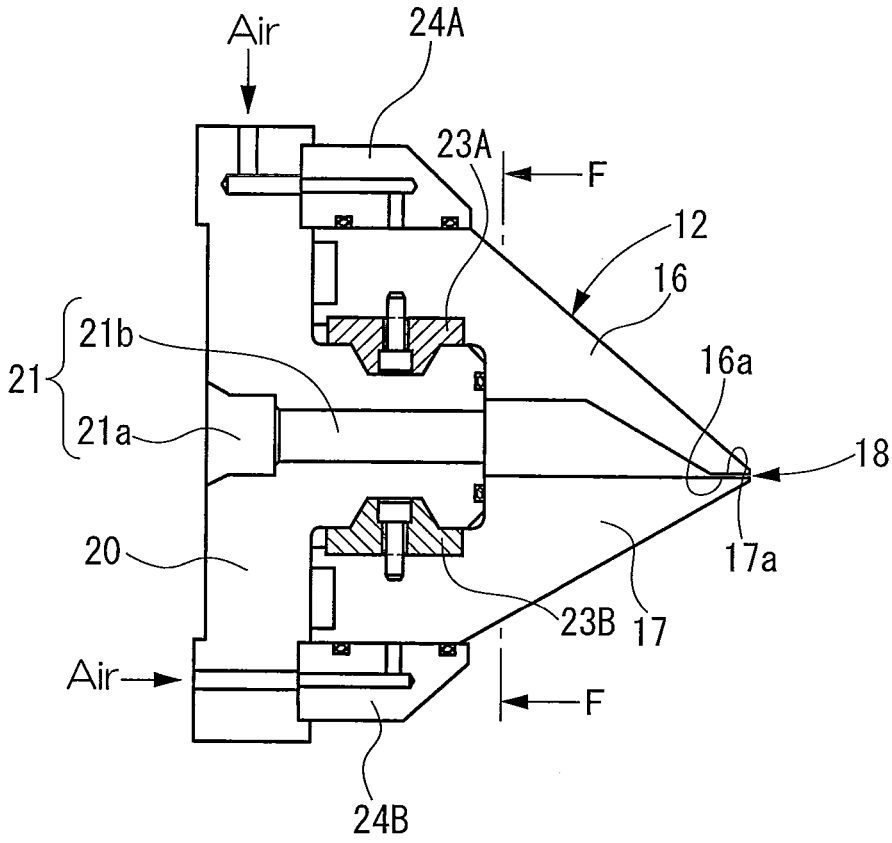
FIG. 3 shows a cross-sectional view indicated by arrows A of FIG. 2B.
Figure 4:
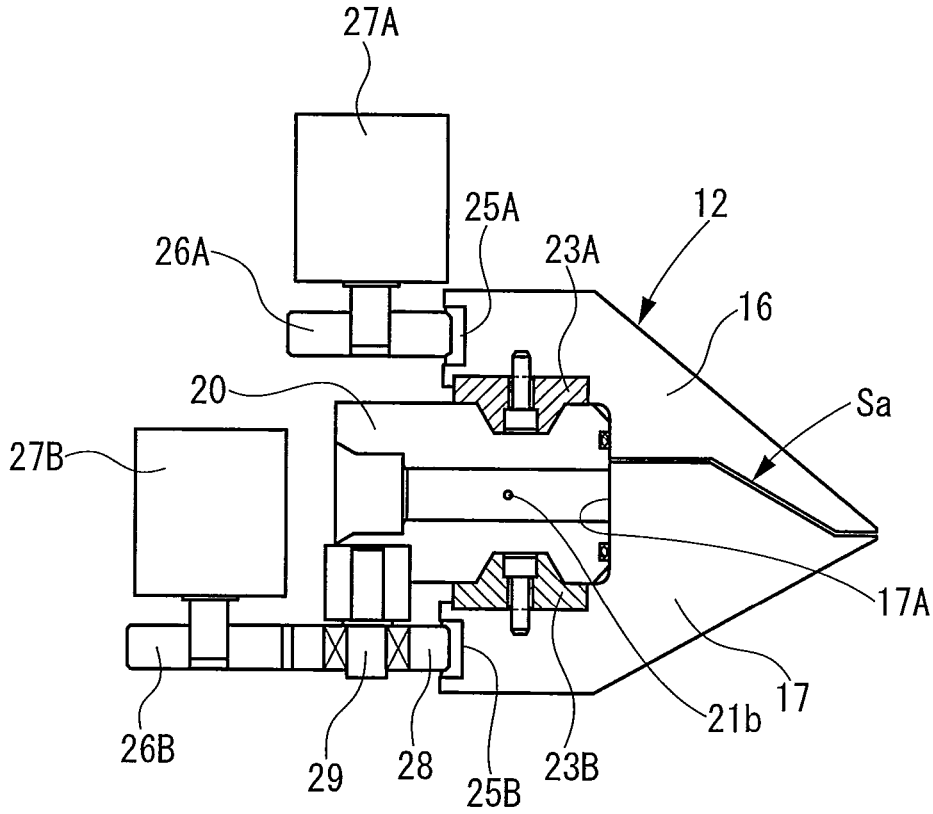
FIG. 4 shows a cross-sectional view indicated by arrows B of FIG. 2B.
Figure 5:
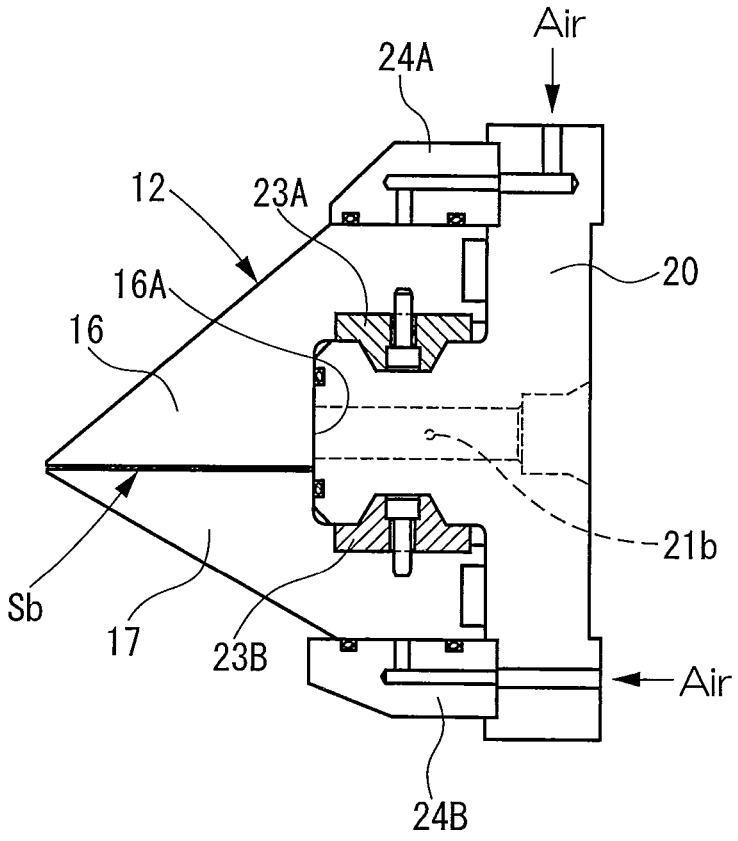
FIG. 5 shows a cross-sectional view indicated by arrows C of FIG. 2B.

FIG. 1 shows a schematic side view of a structure of a gas wiping apparatus used for hot dip galvanizing equipment in a hot dip galvanizing line for zinc and the like, illustrating Embodiment 1 of the present invention. FIG. 2A shows a view corresponding to a cross-sectional view indicated by arrows F of FIG. 3, illustrating another operational state of a wiping nozzle in the case of a narrow strip. FIG. 2B shows a view corresponding to a cross-sectional view indicated by arrows F of FIG. 3, illustrating still another operational state of the wiping nozzle in the case of a wide strip. FIG. 3 shows a cross-sectional view indicated by arrows A of FIG. 2B. FIG. 4 shows a cross-sectional view indicated by arrows B of FIG. 2B. FIG. 5 shows a cross-sectional view indicated by arrows C of FIG. 2B.

As shown in FIG. 1, a pair of gas wiping apparatuses 11 are provided facing front and rear surfaces of a strip (a steel plate being plated) S going out of a molten metal coating pot 10 and running upward. Gas is blown onto the surfaces of the strip S from wiping nozzles 12 of the gas wiping apparatuses 11 (see arrows in FIG. 1) to control a deposit mass (thickness of coated molten metal, film thickness). FIG. 1 shows one of the gas wiping apparatuses 11 provided on the front and rear sides of the strip S. The other gas wiping apparatus 11 has a same structure as that of the shown gas wiping apparatus 11 provided symmetrically thereto with respect to the strip S and is not shown in the drawing.

Specifically, the gas wiping apparatus 11 is designed so that gas supplied from the inside of a nozzle header 13 through a gas supply channel 15 of a manifold 14 to the wiping nozzle 12 blows out from a nozzle slit 18 evenly in a width direction of the strip S. The nozzle slit 18 is defined between facing surfaces 16*a* and 17*a* of upper and lower lips 16 and 17 of the wiping nozzle 12.

In the wiping nozzle 12, a T-shaped slide base (a gas supply base) 20 is laterally connected to a joint flange 19 of the manifold 14 by bolts, and a gas supply channel 21 of the T-shaped slide base 20 communicates with the gas supply channel 15 of the manifold 14 via a gas supply channel 22 of the joint flange 19. The gas supply channel 21 of the slide base 20 is composed of a collective channel portion 21*a* and a multi-hole channel portion 21*b* (see FIGS. 2A and 2B).

To a horizontal protruding portion 20*a* of the slide base 20, the upper and lower lips 16 and 17 are attached in such a manner as to sandwich the protruding portion 20*a* from above and below.

Specifically, base portions of the upper and lower lips 16 and 17 are engaged with upper and lower surfaces of the protruding portion 20*a* with upper and lower sliding liners 23A and 23B interposed therebetween, respectively. The upper and lower lips 16 and 17 are respectively pressed against and fixed to arbitrary places of the upper and lower surfaces of the protruding portion 20*a* by air pressures of upper and lower static pressure pads (lip holders) 24A and 24B attached into the slide base 20. Meanwhile, the upper and lower lips 16 and 17 are configured to be slidable on the upper and lower surfaces of the protruding portion 20*a* in the width direction of the strip S (also referred to as a strip width direction) with the upper and lower sliding liners 23A and 23B interposed therebetween, respectively, when the air pressure of the upper and lower static pressure pads 24A and 24B is released (or reduced).

The upper and lower sliding liners 23A and 23B are oilless liners but may be composed of linear motion guides (LM guides). Moreover, for fixing the upper and lower lips 16 and 17, the upper and lower static pressure pads 24A and 24B are supplied with air pressure from a pressurized air supply such as a compressor through internal channels of the upper and lower static pressure pads 24A, and 24B and slide base 20 and not-shown external pipes. However, the upper and lower static pressure pads 24A and 24B may be supplied with pressure of another fluid instead of air, or the upper and lower static pressure pads 24A and 24B may be replaced with mechanical fixing means.

As shown in FIGS. 2A, 2B, and 3 to 5, a rack (a movement mechanism) 25A is provided on the back of the upper lip 16 to extend in the longitudinal direction thereof. A pinion (a movement mechanism) 26A engaged with the rack 25A is fixed on a spindle of an upper lip moving motor (drive means) 27A, which is supported by proper means on a member for fixing the gas wiping apparatus 11. A rack (a movement mechanism) 25B is provided on the back of the lower lip 17 to extend in the longitudinal direction thereof. An idle gear (a movement mechanism) 28 engaged with the rack 25B is engaged with a pinion (a movement mechanism) 26B fixed on a spindle of a lower lip moving motor (drive means) 27B, which is supported by proper means on a member for fixing the gas wiping apparatus 11. The idle gear 28 is rotatably supported on a supporting shaft 29 implanted in the slide base 20.

The upper and lower lips 16 and 17 can therefore independently slide in arbitrary directions. As the upper and lower lips 16 and 17 slide, blocking faces 16A and 17A closing the multi-hole channel portion 21*b* of the gas supply channel 21 of the slide base 20 partially in the longitudinal direction of the nozzle slit 18 (the strip width direction) are formed in the upper and lower lips 16 and 17 at vertically different positions on the opposite sides from each other in the gas outlet width direction (see FIGS. 4 and 5).

In the portions of the upper and lower lips 16 and 17 including the blocking faces 16A and 17A, the facing surfaces 16*a* and 17*a* of the upper and lower lips 16 and 17 are brought into airtight contact with each other to form side seals Sa and Sb (see FIGS. 4 and 5).

With such a structure, if a strip S with a wide width is changed to another strip S with a narrow width, for example, as shown in FIG. 2A, the upper and lower lips 16 and 17 are slid in mutually opposite directions (see arrows in the drawing) to overlap each other (toward the center of the path line). The gas outlet width of the nozzle slit 18 in the width direction of the strip S is reduced corresponding to the width of the strip S. In other words, gas from a part of the multi-hole channel portion 21*b* in the slide base 20 is blown out of the nozzle slit 18, and the other part of the multi-hole channel portion 21*b* of the slide base 20 is closed by the aforementioned blocking faces 16A and 17A of the upper and lower lips 16 and 17.

On the contrary, when a strip S with a narrow width is changed to another strip S with a wide width, as shown in FIG. 2B, the upper and lower lips 16 and 17 are slid in mutually opposite directions (see arrows in the drawing) to separate from each other (away from the center of the path line). The gas outlet width of the nozzle slit 18 in the strip width direction is increased corresponding to the width of the strip S (to the maximum width in the example of the drawing). In other words, gas from the entire multi-hole channel portion 21*b* of the slide base 20 is blown out from the nozzle slit 18.

Moreover, if the upper and lower lips 16 and 17 slide in a same direction, the gas outlet position in the strip width direction can be changed without changing the gas outlet width of the nozzle slit 18 in the strip width direction. In other words, if the strip S is meandering, the upper and lower lips 16 and 17 can slide following the meandering strip S. The gas outlet width of the nozzle slit 18 in the strip width direction can be always fit to the plate width of the strip S so as to maintain the above-described proper relationship (in terms of the gas outlet width and position).

According to this embodiment, it is possible to avoid waste of gas blowing outside the strip S in the strip width direction and to achieve energy-saving. Specifically, gas blowing outside the strip S in the strip width direction is reduced, and the gas supply can be accordingly reduced under a constant nozzle internal pressure. Conversely, the nozzle internal pressure can be increased with reduced gas supply. In addition, the opposing gas flows outside the strip S in the strip width direction are reduced, and thus it is possible to reduce noise, plate vibration, occurrence of edge over-coating due to high speed collision of the opposing gas flows.

Furthermore, the desired object can be achieved by only sliding the upper and lower lips 16 and 17 including the blocking faces 16A and 17A formed thereon, which close the multi-hole channel portion 21*b* of the gas supply channel 21 of the slide base 20 partially in the longitudinal direction of the nozzle slit 18. This requires only such a simple structure including the aforementioned movement mechanisms composed of the racks and pinions, the drive means composed of the motors, and the like.

[Embodiment 2]

Figure 6A:
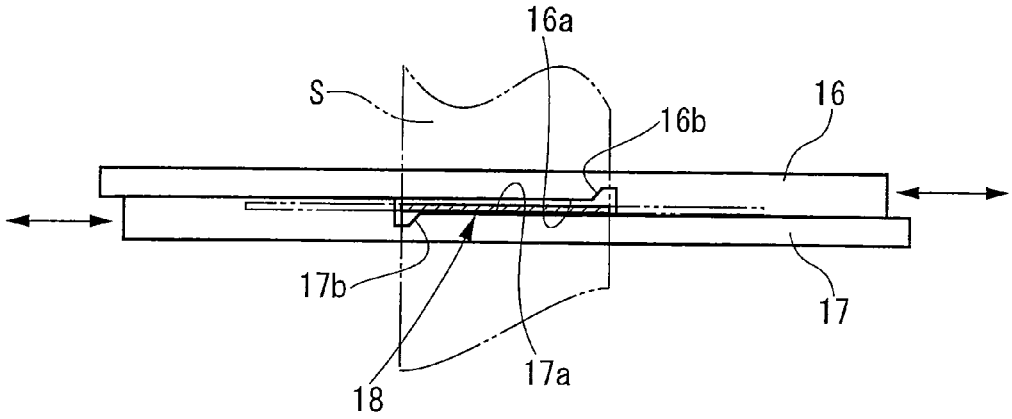
FIG. 6A shows a front view of Embodiment 2 of the present invention, illustrating another operational state of a wiping nozzle in the case of a narrow strip.
Figure 6B:
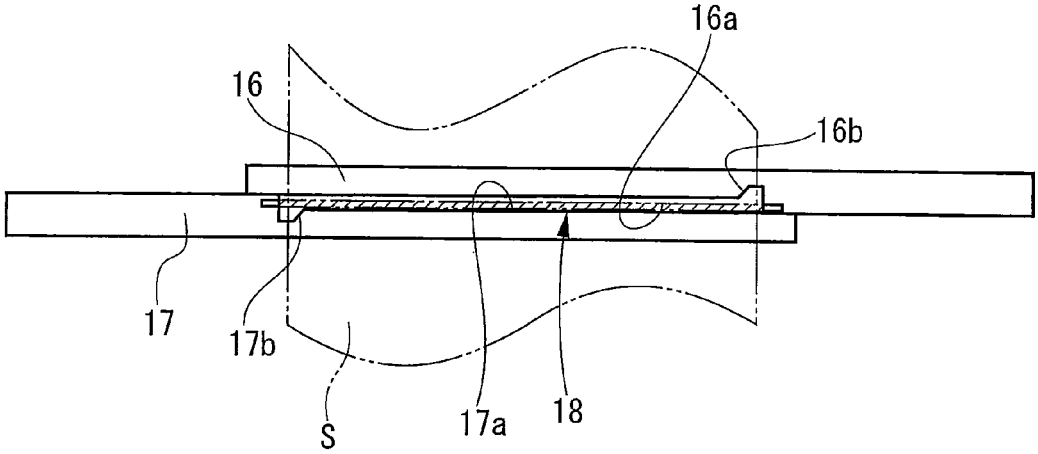
FIG. 6B shows a front view of Embodiment 2 of the present invention, illustrating still another operational state of the wiping nozzle in the case of a wide strip.

FIG. 6A shows a front view of Embodiment 2 of the present invention, illustrating another operational state of a wiping nozzle in the case of a narrow strip. FIG. 6B shows a front view of Embodiment 2 of the present invention, illustrating still another operational state of the wiping nozzle in the case of a wide strip.

In this embodiment, recess portions 16*b* and 17*b* are respectively formed in the portions of the facing surfaces 16*a* and 17*a* forming the nozzle slit 18 of the upper and lower lips 16 and 17 in Embodiment 1, which are positioned always near the respective ends of the strip S. The gap of the nozzle slit 18 is configured to be larger near the ends of the strip S than near the center of the strip S. The configuration of the other components is the same as that of Embodiment 1.

According to this embodiment, in addition to the same operations and effects as those of Embodiment 1, the gas supply near the ends of the strip S is more than that near the center of the strip S. This reduces the influence of high speed collision of the opposing gas flows outside the strip S in the width direction. Accordingly, the wiping performance thus enhanced can further reduce the noise, plate vibration, and occurrence of edge over-coating.

[Embodiment 3]

Figure 7A:
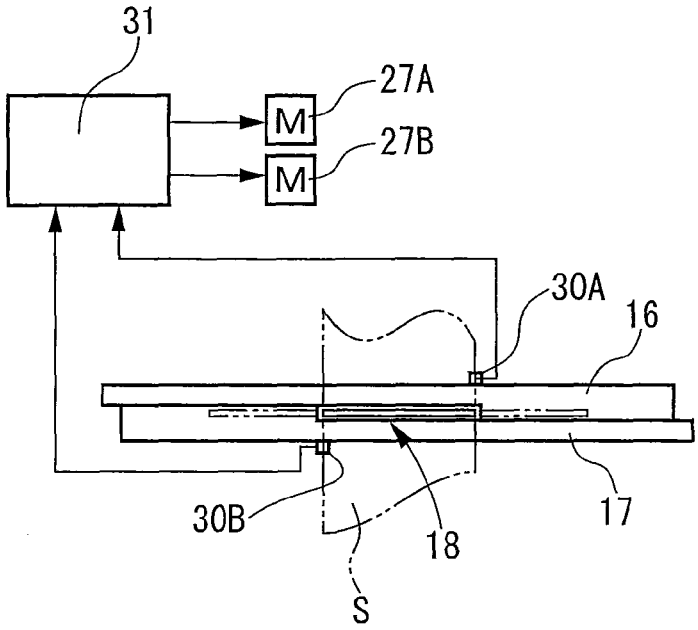
FIG. 7A shows a front view of Embodiment 3 of the present invention, illustrating another operational state of a wiping nozzle in the case of a narrow strip.
Figure 7B:
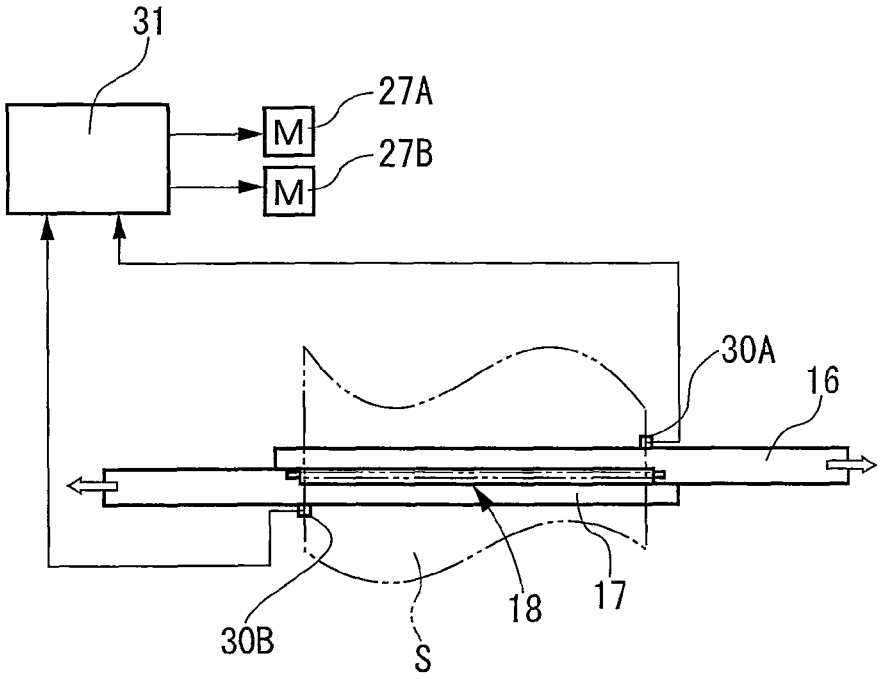
FIG. 7B shows a front view of Embodiment 3 of the present invention, illustrating still another operational state of the wiping nozzle in the case of a wide strip.

FIG. 7A shows a front view of Embodiment 3 of the present invention, illustrating another operational state of a wiping nozzle in the case of a narrow strip. FIG. 7B shows a front view of Embodiment 3 of the present invention, illustrating still another operational state of the wiping nozzle in the case of a wide strip.

In this embodiment, strip end sensors 30A and 30B (such as photo-sensors or 2D laser sensors) are individually attached to the portions, of the upper and lower lips 16 and 17 of Embodiment 1, which are always positioned near the respective ends of the strip S. The upper and lower lip moving motors 27A and 27B are configured to be driven and controlled by a controller (control means) 31 for controlling lip movement. The controller 31 is composed of a microcomputer or the like and receives detection signals from the strip end sensors 30A and 30B. The configuration of the other components is the same as that of Embodiment 1.

According to this embodiment, in addition to the same operations and effects as those of Embodiment 1, the gas outlet width and position of the nozzle slit 18 in the strip width direction can be automatically adjusted at high accuracy.

[Embodiment 4]

Figure 8A:
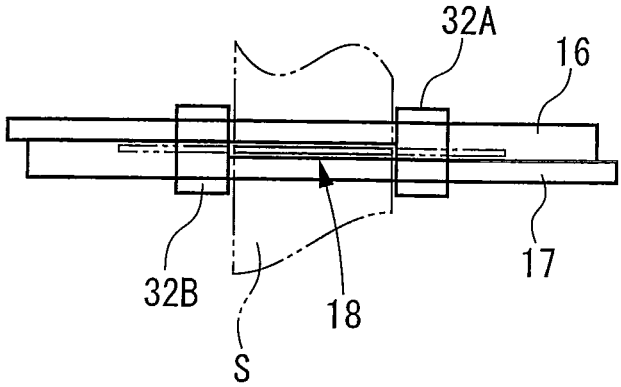
FIG. 8A shows a front view of Embodiment 4 of the present invention, illustrating another operational state of a wiping nozzle in the case of a narrow strip.
Figure 8B:
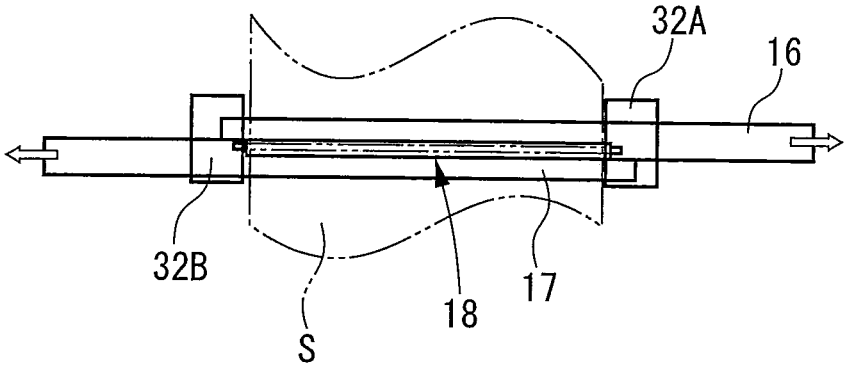
FIG. 8B shows a front view of Embodiment 4 of the present invention, illustrating still another operational state of the wiping nozzle in the case of a wide strip.

FIG. 8A shows a front view of Embodiment 4 of the present invention, illustrating another operational state of a wiping nozzle in the case of a narrow strip. FIG. 8B shows a front view of Embodiment 4 of the present invention, illustrating still another operational state of the wiping nozzle in the case of a wide strip.

In this embodiment, baffle plates 32A and 32B for preventing collision of the opposing gas flows outside the strip S in the strip width direction are individually attached to the portions, of the upper and lower lips 16 and 17 of Embodiment 1, which are always positioned near the respective ends of the strip S. The configuration of the other components is the same as that of Embodiment 1. The baffle plates 32A and 32B are fixed in such a manner as not to move relative to the respective lips 16 and 17 in the strip width direction but is preferably configured to move in a direction perpendicular to the strip width direction and to swing following the movements of the ends of the strip S in the direction perpendicular to the strip width direction.

According to this embodiment, in addition to the same operations and effects as those of Embodiment 1, the ends of the strip S can be positioned near the ends of the respective baffle plates 32A and 32B at high accuracy. It is therefore possible to allow the baffle plates 32A and 32B to fully exert the operational effect thereof, thus further preventing the occurrence of edge over-coating.

[Embodiment 5]

Figure 9:
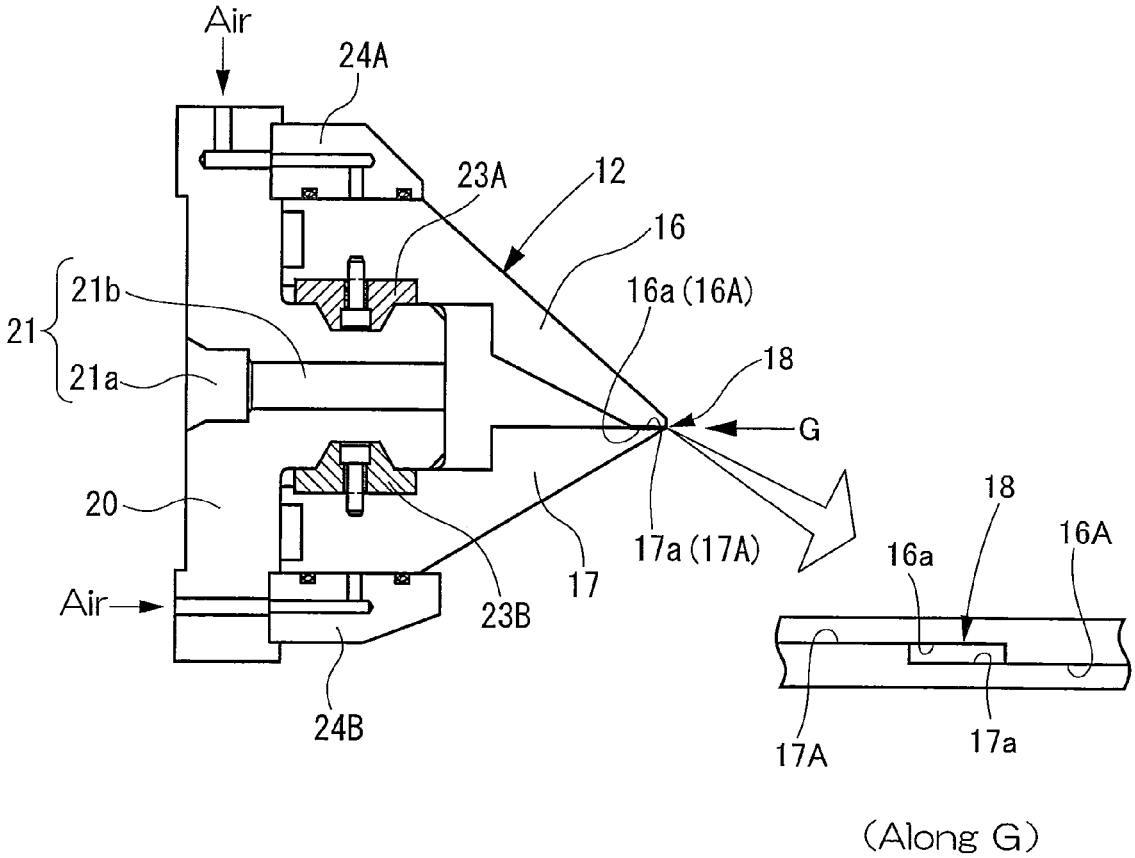
FIG. 9 shows a cross-sectional view of a wiping nozzle illustrating Embodiment 5 of the present invention, which corresponds to the view indicated by the arrows B of FIG. 2B.

FIG. 9 shows a cross-sectional view of a wiping nozzle illustrating Embodiment 5 of the present invention, which corresponds to the view indicated by the arrows B of FIG. 2B.

In this embodiment, the blocking faces 16A and 17A of the upper and lower lips 16 and 17 are formed on the sides of the facing surfaces 16*a* and 17*a* forming the nozzle slit 18, respectively, instead of such portions that the multi-hole channel portion 21*b* of the slide base 20 is partially closed. The configuration of the other components is the same as that of Embodiment 1.

According to this embodiment, it is possible to provide the same operations and effects as those of Embodiment 1.

[Embodiment 6]

Figure 10:
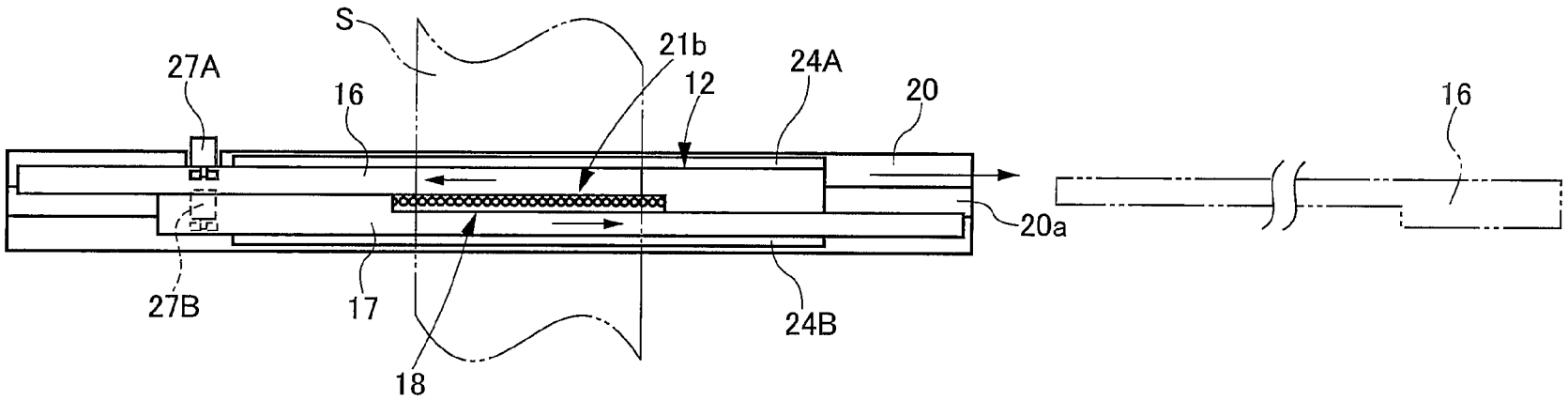
FIG. 10 shows a front view of Embodiment 6 of the present invention, illustrating an operational state of a wiping nozzle.
Figure 11:
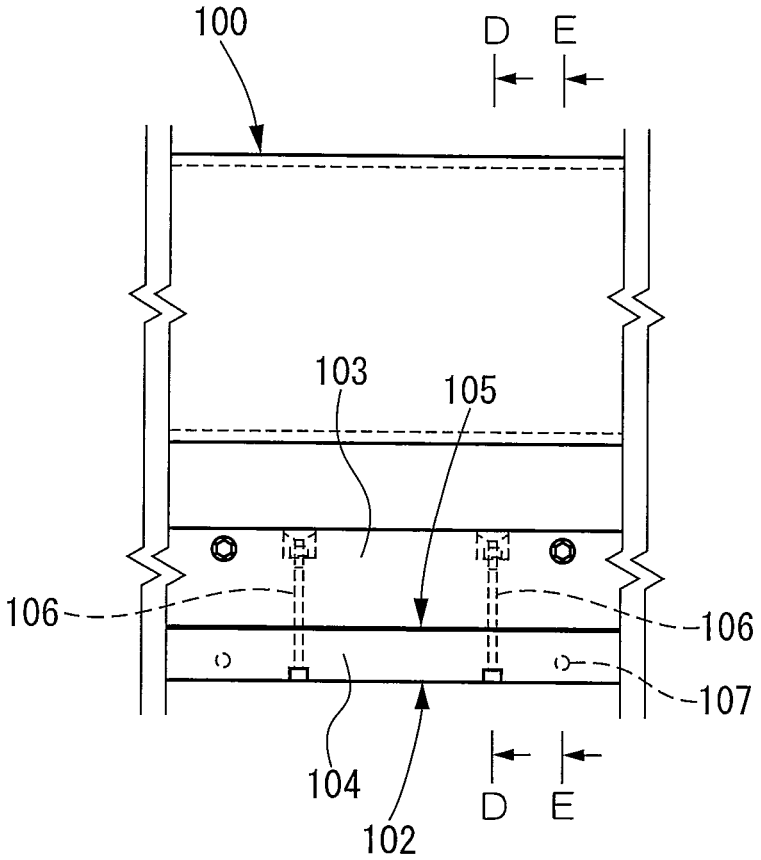
Fig.11 Prior Art
FIG. 11 shows a front view of a main portion of a conventional gas wiping apparatus.
Figure 12A:
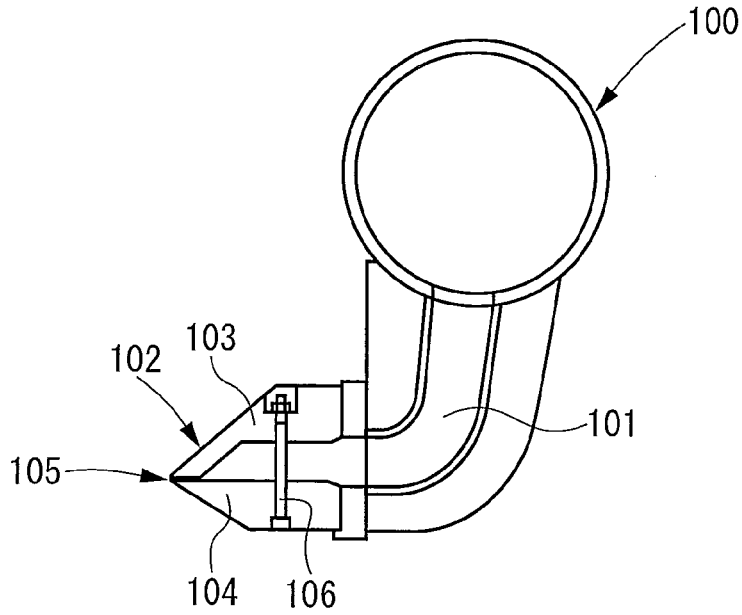
Fig.12A Prior Art
FIG. 12A shows a cross-sectional view indicated by arrows D of FIG. 11.
Figure 12B:
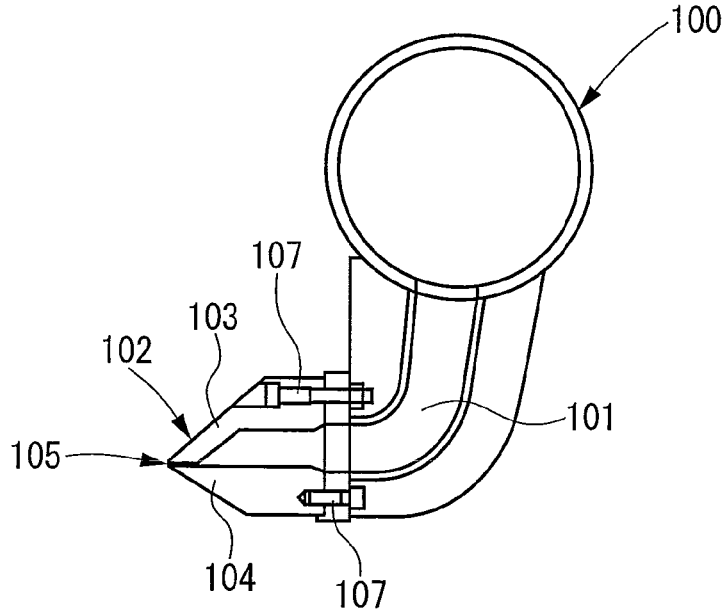
Fig.12B Prior Art
FIG. 12B shows a cross-sectional view indicated by arrows E of FIG. 11.

FIG. 10 shows a front view of Embodiment 6 of the present invention, illustrating an operational state of a wiping nozzle.

In this embodiment, provided is a configuration example in which the upper lip 16 and/or lower lip 17 in Embodiment 1 are replaceable in addition to the configuration in which the gas outlet width of the nozzle slit 18 in the strip width direction is changeable as in the above-descried embodiments, the upper and lower lips 16 and 17 being supported by the movement mechanisms 25A and 25B (see FIG. 4) and drive means 27A and 27B in such a manner as to be independently slidable in arbitrary directions.

Specifically, if the upper lip 16 gets damage from a collision with the strip S or molten metal splashes over to the upper lip 16 while the wiping nozzle 12 is operating in the states shown in FIGS. 2A, and 2B, for example, the coated strip can have quality defects (uneven coating, formation of stripes and the like) in the surface thereof, and the upper lip 16 will need to be replaced.

In this embodiment, the upper lip 16 can be easily detached alone by sliding the upper lip 16 on the upper surface of the protruding portion 20*a* of the slide base 20 in the strip width direction of the strip S with the upper sliding liner 23A (see FIG. 1) interposed therebetween under released (or reduced) air pressure of the upper static pressure pad 24A. The upper lip 16 can be then replaced with a new upper lip 16. It is obvious that the new upper lip 16 can be attached by inverse operation of the above detachment operation. Needless to say, the lower lip 17 can be replaced in the same manner, if necessary.

According to this embodiment, in addition to the same operations and effects as those of Embodiment 1, the upper and lower lips can be replaced easily and independently by sliding the upper or lower lips in the strip width direction, thus reducing time taken to replace the wiping nozzle 12 and increasing the productivity.

The present invention is not limited to the aforementioned embodiments, and it is obvious that various modifications including changing shapes of the upper and lower lips, slide base, and protruding portions thereof can be made without departing from the sprit of the invention. Moreover, the aforementioned embodiments, the gas outlet width and position in the strip width direction can be changed by sliding both of the upper and lower lips. However, it is obvious that the gas outlet width and position in the strip width direction may be changed by moving any one of the upper and lower lips.

The gas wiping apparatus according to the present invention is applicable to steel process lines.

REFERENCE SIGNS LIST

10 MOLTEN METAL COATING POT
11 GAS WIPING APPARATUS
12 WIPING NOZZLE
13 NOZZLE HEADER
14 MANIFOLD
15 GAS SUPPLY CHANNEL
16 UPPER lip
16A BLOCKING FACE
16*a* FACING SURFACE
16*b* RECESS PORTION
17 LOWER lip
17A BLOCKING FACE
17*a* FACING SURFACE
17*b* RECESS PORTION
18 NOZZLE SLIT
19 JOINT FLANGE PORTION
20 SLIDE BASE (GAS SUPPLY BASE)
20*a* PROTRUDING PORTION
21 GAS SUPPLY CHANNEL
21*a* COLLECTIVE CHANNEL PORTION
21*b* MULTI-HOLE CHANNEL PORTION
22 GAS SUPPLY CHANNEL
23A UPPER SLIDING LINER
23B LOWER SLIDING LINER
24A UPPER STATIC PRESSURE PAD (LIP HOLDER)
24B LOWER STATIC PRESSURE PAD (LIP HOLDER)
25A, 25B RACK (MOVEMENT MECHANISM)
26A, 26B PINION (MOVEMENT MECHANISM)
27A UPPER LIP MOVING MOTOR (DRIVE MEANS)
27B LOWER LIP MOVING MOTOR (DRIVE MEANS)
28 IDLE GEAR
29 SUPPORT SHAFT
30A, 30B STRIP END DETECTION SENSOR
31 CONTROLLER FOR CONTROLLING LIP MOVEMENT (CONTROL MEANS)
32A, 32B BAFFLE PLATE
S STRIP (STEEL PLATE BEING COATED)
Sa, Sb SIDE SEAL

The invention claimed is:

1. A gas wiping apparatus configured to blow gas through a wiping nozzle onto front and rear surfaces of a steel plate going out from a molten metal coating pot and running upward and which thereby controls a deposit mass, the apparatus comprising:

the wiping nozzle, separated into an upper lip and a lower lip, wherein blocking faces partially closing a gas supply channel are formed in the upper and lower lips at vertically different positions on opposite sides from each other in a gas outlet width direction, and the upper and lower lips are configured to be independently movable with respect to each other in a width direction of the steel plate by a plurality of drive means in such a manner as to close a nozzle slit at a position coinciding with the plate width of the steel plate.

2. The gas wiping apparatus according to claim 1, wherein recess portions are respectively formed, at such positions as to be always located near ends of the steel plate, in facing surfaces which form the nozzle slit of the upper and lower lips, so that a gap of the nozzle slit is made larger near the ends of the steel plate than near a center of the steel plate.

3. The gas wiping apparatus according to claim 1, comprising:

plate end detection sensors respectively attached to the upper and lower lips so as to detect end portions of the steel plate; and control means for controlling the drive means on a basis of detection signals from the plate end detection sensors so as to adapt the upper and lower lips to changes in position of the end portions of the steel plate.

* * * * *